US010920947B2

(12) United States Patent
Gromfeld

(10) Patent No.: US 10,920,947 B2
(45) Date of Patent: Feb. 16, 2021

(54) LIGHTING DEVICE FOR A MOTOR VEHICLE HEADLIGHT

(71) Applicant: Valeo Vision, Bobigny (FR)

(72) Inventor: Yves Gromfeld, Avrille (FR)

(73) Assignee: Valeo Vision, Bobigny (FR)

( * ) Notice: Subject to any disclaimer, the term of this patent is extended or adjusted under 35 U.S.C. 154(b) by 195 days.

(21) Appl. No.: 15/219,660

(22) Filed: Jul. 26, 2016

(65) Prior Publication Data

US 2017/0030542 A1 Feb. 2, 2017

(30) Foreign Application Priority Data

Jul. 28, 2015 (FR) ..... 1557183

(51) Int. Cl.

| | |
|---|---|
| ***F21S 41/24*** | (2018.01) |
| ***F21S 41/265*** | (2018.01) |
| ***F21S 41/27*** | (2018.01) |
| ***F21S 41/26*** | (2018.01) |
| ***F21S 41/148*** | (2018.01) |
| *F21S 45/48* | (2018.01) |
| *F21Y 115/10* | (2016.01) |

(52) U.S. Cl.

CPC ..... *F21S 41/24* (2018.01); *F21S 41/148* (2018.01); *F21S 41/26* (2018.01); *F21S 41/265* (2018.01); *F21S 41/27* (2018.01); *F21S 45/48* (2018.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 7,261,449 | B2 | 8/2007 | Albou | |
| 7,731,402 | B2 * | 6/2010 | Tessnow | F21S 41/143 362/545 |
| 8,186,854 | B2 | 5/2012 | Albou | |
| 8,388,202 | B2 * | 3/2013 | Ohno | F21S 41/24 362/520 |
| 8,920,006 | B2 | 12/2014 | de Lamberterie | |
| 9,574,731 | B2 * | 2/2017 | Giraud | G02B 6/0033 |
| 2005/0180153 | A1 | 8/2005 | Albou | |
| 2006/0239020 | A1 | 10/2006 | Albou | |

(Continued)

FOREIGN PATENT DOCUMENTS

| | | | |
|---|---|---|---|
| EP | 1564481 | A1 | 8/2005 |
| EP | 1715245 | A1 | 10/2006 |
| EP | 2045515 | A1 | 4/2009 |

*Primary Examiner* — Sharon E Payne

(74) *Attorney, Agent, or Firm* — Oblon, McClelland, Maier & Neustadt, L.L.P.

(57) ABSTRACT

A lighting device, notably for a motor vehicle, comprising at least one module having an optical axis O, each module having:

- a light source configured to emit a light beam in an overall direction substantially forming a secant to the optical axis O and
- a light orientation guide adapted to direct the light beam emitted by the light source in a manner substantially parallel to said optical axis O at the output of said the light orientation guide and adapted to form a cut-off in the light beam.

The lighting device comprises a single portion for the output of the light beam, the output surface of which is continuously curved and is common to all the modules.

23 Claims, 4 Drawing Sheets

(56) References Cited

U.S. PATENT DOCUMENTS

| | | | | |
|---|---|---|---|---|
| 2008/0198574 | A1* | 8/2008 | Woodward | F21S 41/143 362/85 |
| 2009/0091944 | A1 | 4/2009 | de Lamberterie | |
| 2014/0104864 | A1 | 4/2014 | Brendle | |
| 2014/0133168 | A1* | 5/2014 | Fiederling | F21S 41/143 362/511 |
| 2015/0085511 | A1* | 3/2015 | Shibata | B60Q 1/0683 362/512 |

* cited by examiner

LIGHTING DEVICE FOR A MOTOR VEHICLE HEADLIGHT

CROSS-REFERENCE TO RELATED APPLICATIONS

This application claims priority to the French application 1557183, filed Jul. 28, 2015, which application is incorporated herein by reference and made a part hereof.

BACKGROUND OF THE INVENTION

1. Field of the Invention

The present invention relates to a lighting device.

A preferred application relates to the motor vehicle industry for the production of signaling and/or lighting devices, notably for vehicle headlights.

In the latter field, there are known headlights, which conventionally include dipped headlights, or low beam lights, with a range on the road of about 70 meters, which are essentially used at night, and in which the distribution of the light beam is such that it avoids dazzling the driver of an oncoming vehicle. Typically, the cross section of the upper part of this beam has a horizontal portion, preferably about 0.57 degrees below the horizon, to avoid lighting the area in which the driver of an oncoming vehicle is likely to be present.

This field also includes high beam lights and fog lights, both of which types have cut-off beams.

2. Description of the Related Art

There are known lighting devices for such lights, having at least one light source and at least one guide for the orientation of the light rays between the source and an output face. In particular, the patent document EP2045515, which is equivalent to U.S. Publication No. 2009/0091944 and U.S. Pat. No. 8,920,006, discloses a lighting device of this type with a reduced overall size, due to the fact that the light source is oriented perpendicularly to the optical axis of the device, and the rays are reflected at 90° within the guide.

The drawback of this device lies in the shape of the output face of the guide, which is unattractive in appearance.

This is because the output faces of the lighting devices are visible from the front of a vehicle through the outer lens of the optical unit. In the case of the cited document, the output face forms part of a cylindrically shaped end piece when viewed from the outside. If there is a plurality of guides for a plurality of light sources, there is a plurality of cylindrically shaped end pieces placed side by side and offset in depth so as to be more or less close to the outer lens.

However, the current trend is to have increasingly compact lighting systems, in which the output surfaces preferably follow the curved profiles of the outer lenses.

The use of a plurality of cylindrical output faces results in a relatively unattractive appearance and prevents the preservation of the continuity of curvature of the outer lens located opposite these faces.

Accordingly, the object of the invention is to propose a compact lighting system whose output surface is curved, and preferably follows the profile of the outer lens located after the system.

SUMMARY OF THE INVENTION

The lighting device for a motor vehicle according to the invention comprises at least one module having an optical axis O, each module having:

- a light source configured to emit a light beam in an overall direction substantially forming a secant to the optical axis O;
- a light orientation guide adapted to direct the light beam emitted by the light source in a manner substantially parallel to the optical axis O at the output of the guide and adapted to form a cut-off in the beam.

The overall direction is defined by the mean direction of the light beam composed of all the rays emitted by the light source. Advantageously, this overall direction may be substantially perpendicular to the optical axis. In a variant, the overall direction may be at an angle to the optical axis O in the range from 15° to 75°, notably from 40° to 50°, or possibly substantially equal to 45°.

The lighting device is mainly characterized in that it comprises a single portion for the output of the light beam, the output surface of which is continuously curved and is common to all the modules.

If appropriate, the output surface is smooth.

Thus the lighting device according to the invention creates one or more beams projected toward infinity, with a cut-off profile, while having a single, curved, visually appealing output surface that can be seen through the outer lens of a headlight. This device therefore has the advantage of using a single output surface, to be used with one or more light sources that are to provide specific lighting or signaling functions. In fact, it can produce a wide variety of light beams, according to the number and positioning of the associated light sources, to meet different needs and requirements for lighting.

Additionally, this device has a compact geometry because the rays are reflected at 90° within the guide, enabling the source to project rays perpendicularly to the optical axis, for example, and to be positioned close to the output surface, as compared with a conventional device in which the source projects rays in a direction parallel to the optical axis and is positioned remotely from the output surface. The device according to the invention therefore has the advantage of taking up little space.

The guide has an important function because it creates this 90° reflection. The guide comprises three optical surfaces, namely:

- an input face associated with the light source;
- an output face coinciding with the common output surface of the lighting device;
- a reflecting face for reflecting the light rays sent from the input face toward the output face.

The 90° reflection is therefore carried out by the reflecting face of the guide.

The expression "input face associated with the light source" signifies that the source may be directly applied to, or placed in the immediate proximity of, the input face. However, this expression also covers configurations in which the source is not in direct contact with the input face, notably the configuration in which at least one optical component such as a collector, collimator, or simple light duct is interposed between the source and the emitting edge, for example in order to improve and/or increase the amount of light penetrating into the guide through the input face, while further limiting light leaks, and/or in order to make it possible to position the source remotely.

Advantageously, the light guide is formed from a material adapted to enable the light beam to be reflected on the reflecting face by total internal reflection.

In a variant, the reflecting face may be covered with a reflective coating.

According to different embodiments of the invention, which may be considered separately or in combination:

the input face of the guide is arranged so as to refract the light beam received from the light source toward the reflecting face;

the input face may be flat or non-flat, notably curved;

the reflecting face of the guide is arranged to collect the refracted light beam received from the input face and to reflect this light beam toward the output face of the guide;

the reflecting face has a focus F and the light source is positioned in the vicinity of this focus F so that the light beam reflected by the reflecting face toward the output face has a cut-off. If necessary, the light source is positioned relative to the focus of the reflecting face in such a way that the light beam emitted from the output face has a flat cut-off, notably a horizontal cut-off, or, in a variant, an oblique cut-off;

the reflecting face has a generally parabolic profile allowing a focus F to be located near the light source. This reflecting face may have a cylindrical shape with a parabolic generatrix and a directrix running along an axis Y perpendicular to the optical axis O;

the reflecting face is optically related to the output face and to the desired distribution of the light rays at the output of the module. If necessary, the reflecting face may be smooth. In a variant, the reflecting face may be equipped with optical patterns such as striations, or may be faceted;

the light source has a center of symmetry off-center relative to the focus F of the reflecting face with an offset in the direction of the optical axis O;

the light source has a surface for the emission of the beam equipped with a lateral edge, and the light source is arranged so that the focus F of the reflecting face is positioned on this edge;

the light source is positioned so that the edge is substantially perpendicular to the optical axis O;

the light source is positioned so that the edge is at an angle substantially equal to 15° to the optical axis O;

the output face of the guide is arranged to project the light beam reflected by the reflecting face to infinity. The term "infinity" denotes a distance much greater than the dimensions of the module, for example 25 m. If appropriate, the device has no optical projection system other than the output face of the module;

the output face of the guide is arranged so that the rays emerging from the output face are collimated, notably along the optical axis O of the module;

the lighting device comprises a plurality of modules, the guides having lateral walls to prevent the rays sent from a light source associated with a guide from passing into the adjacent guide. In this case, the light beam emitted by a light source is propagated in the guide associated with it by total internal reflection on the lateral walls;

the lateral walls of the guides may, for example, be aluminum-coated. In this way, the walls can efficiently reflect the light beams toward the output face of the guide;

the lighting device comprises at least one module of a device in which the edge of the light source is substantially perpendicular to the optical axis, and a module of a device in which the edge of the light source is at an angle to the optical axis substantially equal to 15°;

the distance between the light source and the common output surface of the device varies according to the lighting functions of the modules;

the common output surface of the lighting device is made in one piece;

the common output surface is convex relative to the outside of the lighting device;

for each guide, the output face extends transversely or obliquely to the input face;

the light source may be a single light-emitting diode (LED). A diode of this type provides a high-quality light beam, while still having a small size. It is therefore perfectly suitable for a module according to the invention, whose dimensions must be limited in order to be able to be incorporated in a motor vehicle;

the light source may be an LED formed by the association of a plurality of emitting chips of the aligned LED type.

The invention also proposes a headlight for a motor vehicle comprising at least one lighting device as described above.

Advantageously, this headlight comprises:

a housing to be fixed on a vehicle, an outer lens for sealing the housing, the lighting device being housed inside the space delimited by the housing and the sealing outer lens, the lighting device being arranged so that the rays emerging from the common output surface reach the sealing outer lens.

Advantageously, the rays emerging from the common output surface reach the outer lens without encountering any obstacle.

Preferably, the rays emitted from the output of the lighting device form a part or the whole of a regulation beam of the high or low beam type.

This headlight is fitted to a motor vehicle for the purpose of illuminating the road.

These and other objects and advantages of the invention will be apparent from the following description, the accompanying drawings and the appended claims.

BRIEF DESCRIPTION OF THE ACCOMPANYING DRAWINGS

The invention will be better understood and other objects, details, characteristics and advantages thereof will be more fully apparent from the following detailed explanatory description of at least one embodiment of the invention, provided solely by way of purely illustrative and non-limiting example, with reference to the attached schematic drawings.

DETAILED DESCRIPTION OF THE PREFERRED EMBODIMENTS

The terms "vertical" and "horizontal" are used in the present description to denote directions, notably beam cut-off directions, having an orientation perpendicular to the plane of the horizon for the term "vertical", and having an orientation parallel to the plane of the horizon for the term "horizontal". They are to be considered in the conditions of operation of the device in a vehicle. The use of these words does not mean that small variations around the vertical and horizontal directions are excluded from the invention. For example, an inclination of about + or −10° relative to these directions is considered here as a minor variation around the two predominant directions.

Similarly, throughout the present text, the terms "front" and "rear" are to be interpreted in relation to the direction of propagation of the light emerging from the lighting device toward the front.

The term "parallel" or the concept of coincident axes is to be interpreted here, notably, as subject to manufacturing or assembly tolerances, and substantially parallel directions or substantially coincident axes are included in this context.

The cut-off profile is preferably understood in the sense of the formation of an output beam which is not uniformly distributed around the optical axis because of the presence of an area of less exposure to light, this area being substantially delimited by a cut-off profile which may be formed by at least two, and notably three segments of a straight line forming an angle between them or having a more complex shape in cornering such as oblique cut-offs.

The case shown in the various figures is particularly suitable for installation in a headlight of a motor vehicle.

With reference to FIGS. 1 to 6, the lighting device is shown in a configuration with only one module, that is to say having only a single light source 8. This module has an optical axis O, which specifies the final orientation of the rays emerging from the module.

Figure 1:
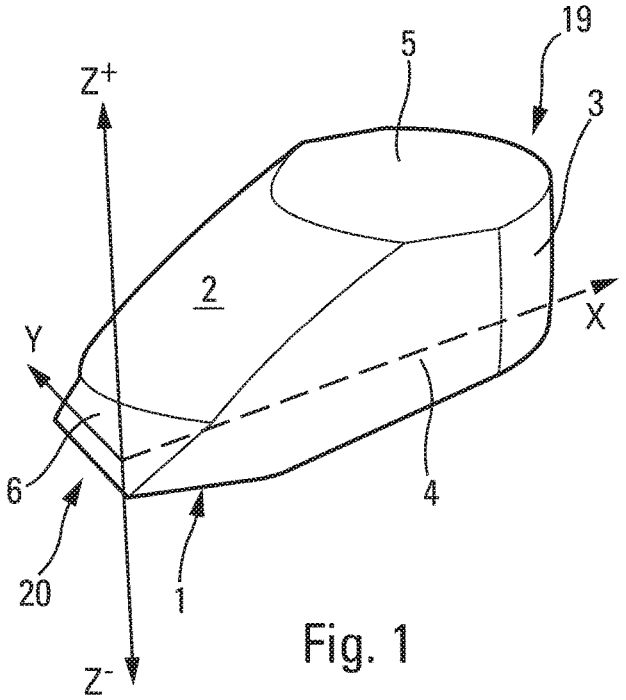
FIGS. 1 and 2 are perspective views of the lighting device of the invention, in an embodiment with one module.
Figure 2:
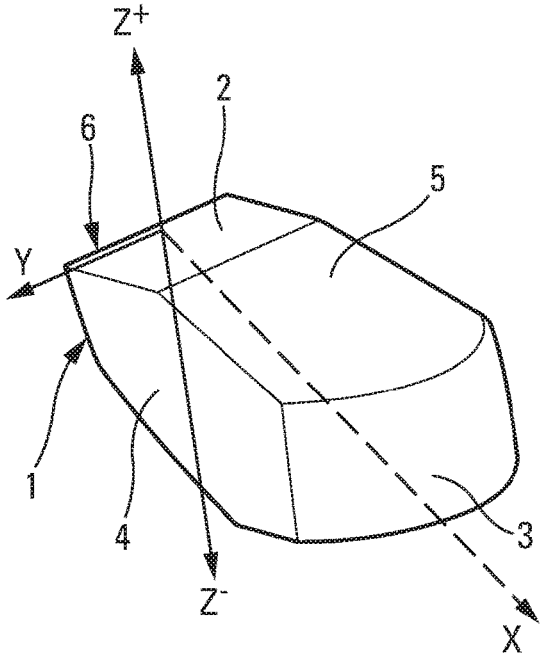
Figure 3:
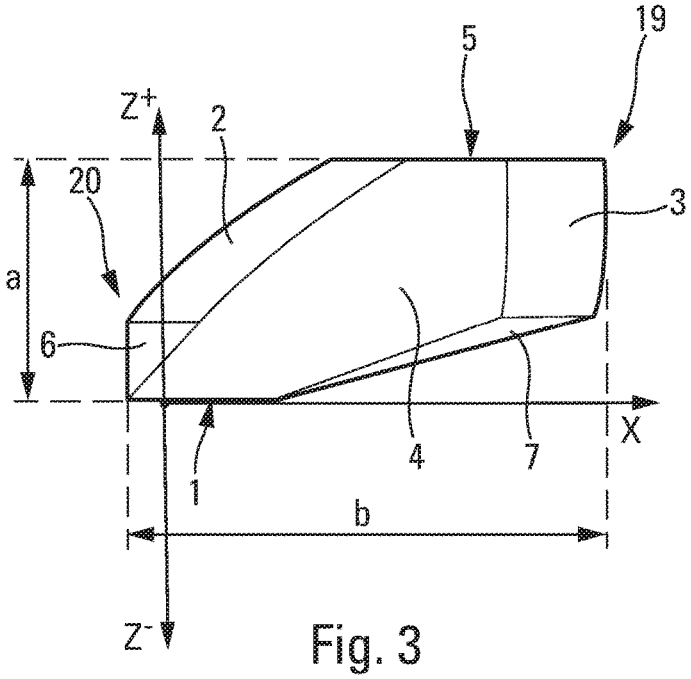
FIG. 3 is a side view of the lighting device according to FIGS. 1 and 2.
Figure 4:
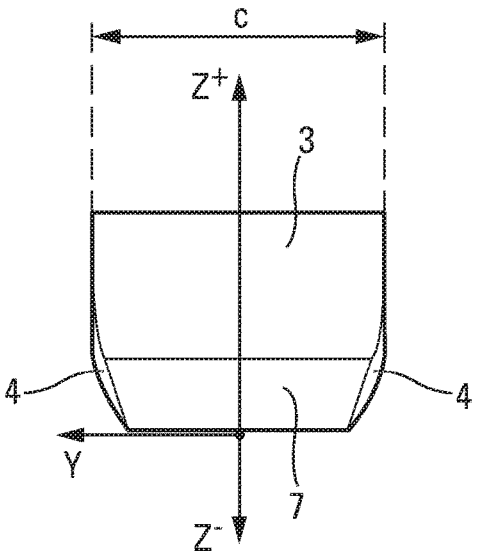
FIG. 4 is a front view of the lighting device according to FIGS. 1 and 2.
Figure 5:
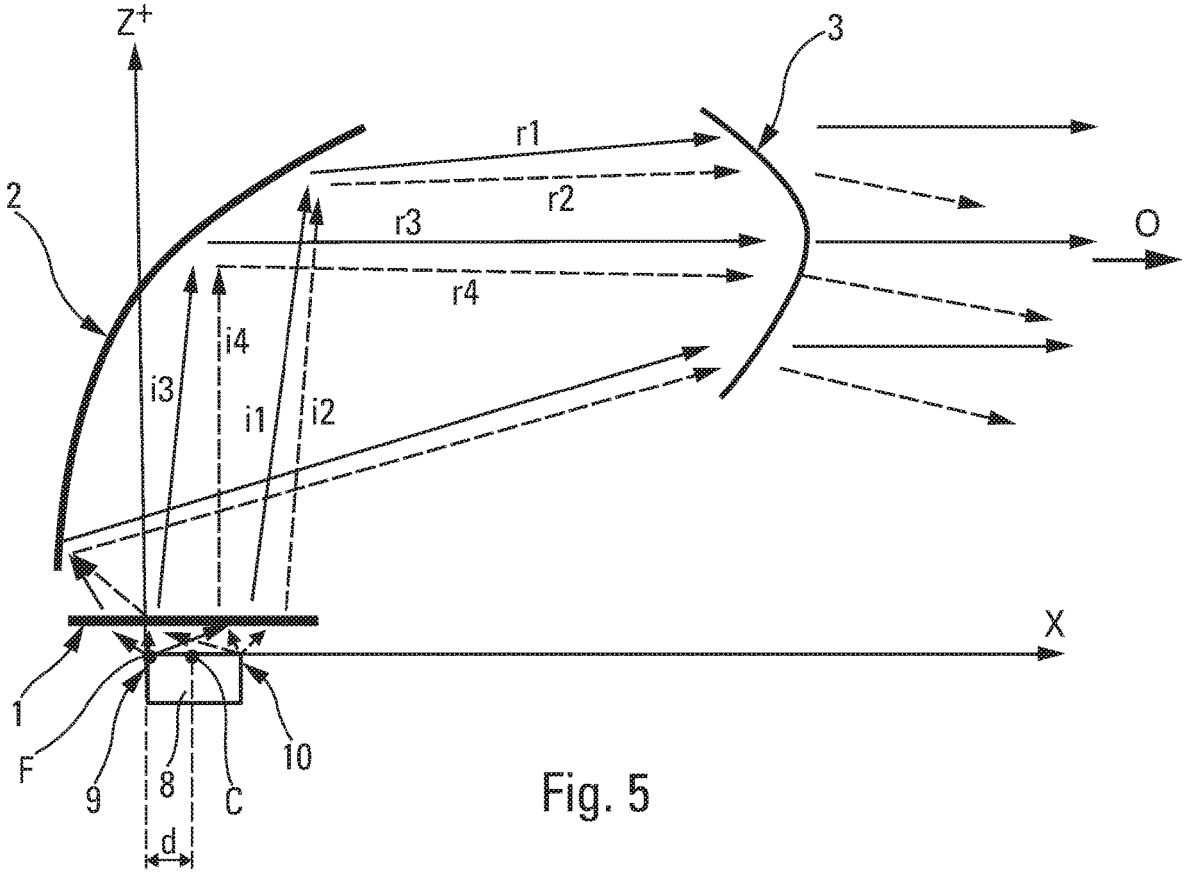
FIG. 5 shows schematically the path followed by the light rays within the lighting device.
Figure 6:
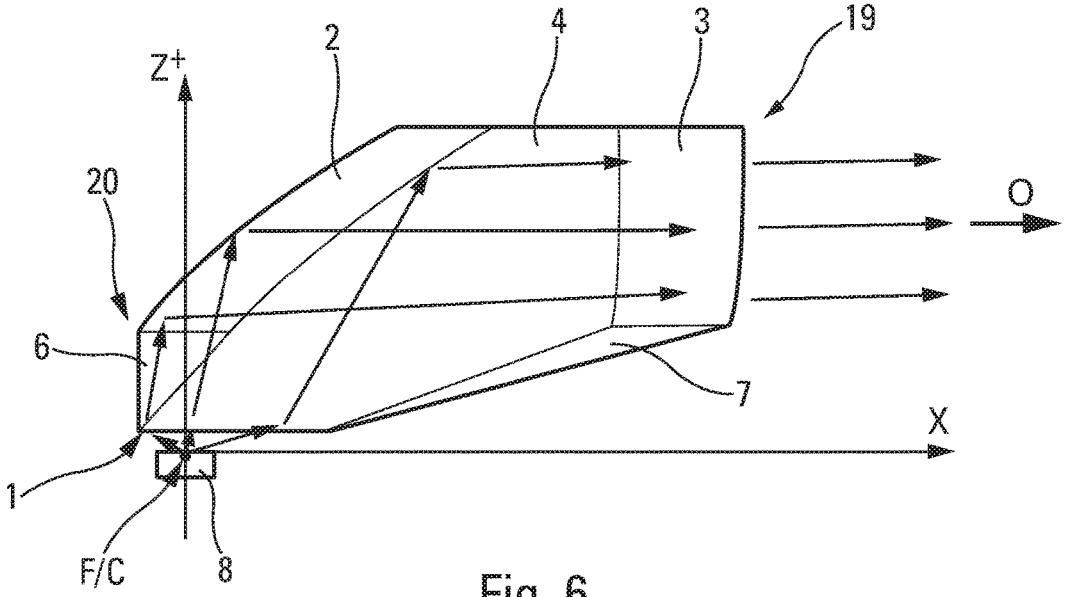
FIG. 6 is a side view of the lighting device and includes part of the schematic view of FIG. 5.

The light source 8 is shown in FIGS. 5 and 6, and is configured to emit light rays. Here, the light source 8 comprises a light-emitting diode (LED).

The LED 8 is positioned opposite an input face 1 of a light orientation guide, so that the emitted light rays penetrate into the light orientation guide through the input face 1. The light orientation guide is configured to direct the light rays toward an output face or surface 3, orientating them so as to be substantially parallel to a horizontal plane.

The light orientation guide is, notably, shown in FIGS. 1 to 4. It comprises:

- an input face 1 as mentioned previously, which is horizontal and located in the lower part of the light orientation guide, under which face the LED 8 is to be positioned;
- a reflecting face 2 positioned facing the input face 1 and oriented obliquely;
- a continuation face 6 of the reflecting face 2 which meets the input face 1 and is located at the rear 20 of the module;
- an output face 3 as mentioned previously, which is vertical and located at the front 19 of the module;
- a horizontal top face 5 forming the junction between the reflecting face 2 and the output face 3;
- an oblique bottom face 7 forming the junction between the input face 1 and the output face 3; and
- two vertical parallel lateral faces or walls 4 whose contour is delimited by all the other aforesaid faces of the module.

In a particular example, the lighting device with a single module may have the following dimensions:

dimension b in the direction X: 60 mm;
dimension c in the direction Y: 40 mm; and
dimension a in the direction Z: 31 mm.

The output face 3 extends transversely to the input face 1.

The input face 1 is flat in the present example, but could be curved in another example, being defined in a conventional manner by a scanning ray and a profile ray.

The output face 3 is rounded and has a visually appealing curvature seen from the outside of the module. This output face 3 acts as a collimating lens.

The reflecting face 2 has a curved shape associated with the profile of the output face 3 so that the light rays emerging from the light orientation guide have a direction substantially parallel to a horizontal plane. This curved shape corresponds more particularly to a parabolic shape.

The focus F of this parabola is located under the input face 1. One point of the LED 8 is placed at the focus F of the parabola, as shown in FIGS. 5 and 6. In the case of FIG. 6, the center C of the LED 8 is located at the focus F of the parabola, while, in the case of FIG. 5, an edge 9 of the LED 8 is located at the focus F of the parabola.

The LED 8 emits a light beam toward the input face 1. This beam is vertical, the LED 8 being configured to fire along the axis Z and in the direction Z+. The rays of this beam are then refracted by the input face 1, and are propagated vertically toward the reflecting face 2. The latter face provides total reflection of the incident rays, and redirects them into the light orientation guide, toward the output face 3, in a substantially horizontal direction.

The rays incident on the reflecting face 2 are therefore perpendicular to the rays reflected by the reflecting face 2. The latter face therefore reflects the rays at 90°.

The output face 3 provides collimation, that is to say the generation of a beam of parallel rays in the direction of the optical axis O of the module, in the horizontal plane.

FIG. 6 shows the optical principle of the basic concept: all the rays emitted by the LED 8 enter the light orientation guide and are guided there along a path comprising a right angle, and are then collimated in the direction of the optical axis O.

With this 90° reflection, the module has the advantage of having a smaller overall size in its dimension b in the direction X.

It should be noted that the reflecting face 2 is optically related to the output face 3 and to the desired distribution of the rays at the output. In particular, since the output face 3 has more of an aesthetic than an optical function, and simply serves to collimate the beam, the reflecting face 2 has a major part to play in the optical principle of the module, and must orient the rays in the light orientation guide in a suitable manner, so as to compensate for the lack of optical effect of the output face 3 because of its curved shape.

The module as described could be turned over horizontally, so that the LED 8 is configured to fire along the axis Z and in the direction Z−. In this case, the rays will be oriented toward the bottom of the module, vertically, instead of toward the top of the module. However, the operation of the module is identical, with the same optical principle.

The light beams obtained with the lighting device according to the invention comprise a cut-off area, that is to say a boundary between a bright area and a dark area to avoid dazzling drivers or persons traveling in the opposite direction to the vehicle concerned. A cut-off of this type is essential in light beams intended to provide functions such as those of low beam lights, fog lights, additional highway lights, additional cornering lights, etc.

A cut-off can be provided by positioning the light source 8 in such a way that the focus F of the parabola forming the reflecting face 2 is located on the rear edge 9 of the source 8, instead of being located in the center C of the light source 8. The LED 8 is therefore significantly offset by a distance d equal to half of its width in the direction X.

With this arrangement, as shown in FIG. 5, a light ray i1 coming from the rear edge 9 of the light source 8, and therefore from the focus F, is simply refracted by the input face 1, and then reflected perpendicularly as a ray r1 toward the output face 3. In the example considered here, the ray r1 is substantially horizontal. It will remain in a horizontal plane at the output of the device.

All the other light rays emitted by the light source 8 will come from points located at the front of the rear edge 9 of the light source 8, as does the ray i2. This ray i2 is refracted and then reflected as a descending ray r2.

Another ray i3 coming from the rear edge 9 will be reflected as a horizontal ray r3, while another ray i4 coming from a point located at the front edge 10 will be reflected as a ray r4 directed downward.

The resulting beam will therefore have a horizontal cut-off line with a bright area below this cut-off line and a dark area above.

If the module is turned over horizontally with an LED 8 firing rays in the direction Z−, the horizontal cut-off can be provided by positioning the LED 8 logically in such a way that the focus F of the parabola forming the reflecting face 2 is located on the front edge of the light source 8, instead of being located on the rear edge 9.

In order to obtain certain lighting effects, the LED 8 may be movable in rotation about the axis Y with an angle in the range +/−45° and/or around the axis Z with an angle in the range +/−15°. This freedom of movement of the LED 8 makes it possible, notably, to generate a light beam with a cut-off partially oblique toward the left or toward the right, so as to illuminate traffic signs and sidewalks or road shoulders on the left-hand part of the road (for driving on the left) or on the right-hand part of the road (for driving on the right).

Figure 7:
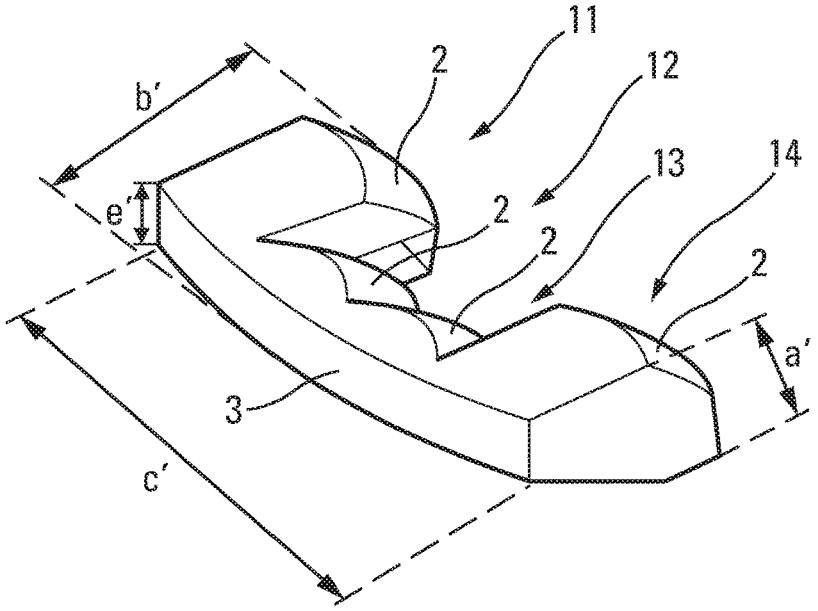
FIGS. 7 and 8 are perspective views of the lighting device of the invention, in an embodiment with four modules.
Figure 8:
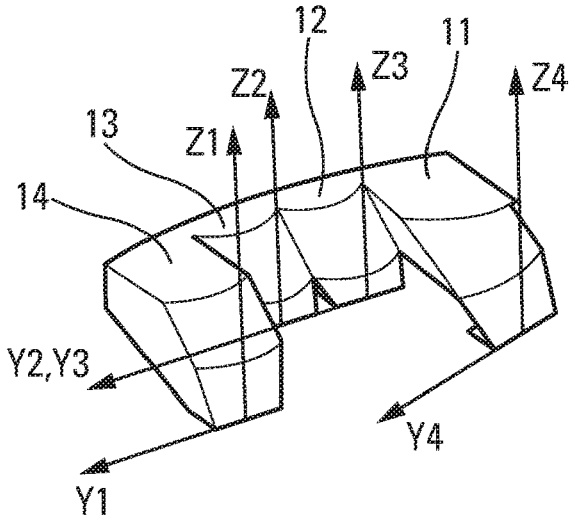

FIGS. 7 and 8 show an embodiment in which the lighting device according to the invention is composed of four modules 11, 12, 13, 14.

These four modules 11, 12, 13, 14 are aligned side by side and have a single continuous output surface 3 which is therefore common to the modules 11, 12, 13, 14. This common output surface 3 therefore incorporates the four output faces of the four modules 11, 12, 13, 14.

This output surface 3 has a curved shape which is visually appealing. It will be visible from the outside through an outer lens 15 of a headlight. Preferably, this output surface 3 follows the curvature of the outer lens 15 of the headlight.

Each of the modules 11, 12, 13, 14 performs a clearly specified lighting function. Thus the modules 11, 12, 13, 14 are not identical to each other. They show variations in the shapes of their faces, and in their dimensions, notably along the direction X.

In the present case, the end modules 11, 14 have a dimension in the direction X which is markedly greater than that of the central modules 12, 13. Therefore, the position of the light sources 8 will also differ according to the modules 11, 12, 13, 14 with which they are associated. In other words, the distance between the light source 8 and the common output surface 3 of the device varies according to the lighting functions of the modules 11, 12, 13, 14.

Figure 9:
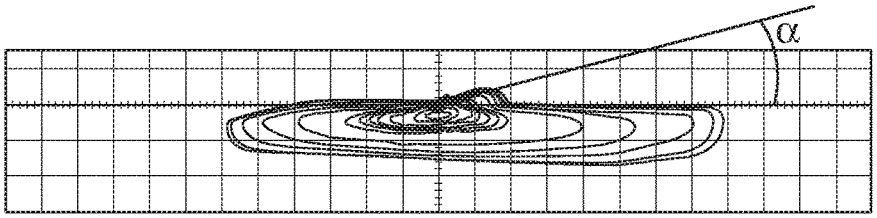
FIG. 9 is a grid of isolux curves obtained with the device of FIGS. 7 and 8.

This type of lighting device with four modules 11, 12, 13, 14 can be used, for example, to generate lighting with an oblique cut-off toward the right, as illustrated by the grid of isolux curves in FIG. 9. The isolux curves were obtained on a screen placed at 25 meters from the lighting device, perpendicularly to the general optical axis of the device, whose intersection with the screen corresponds to the graduation 0° on the horizontal axis. The vertical axis passing through 0° corresponds to the intersection of the screen and the vertical plane passing through the general optical axis.

These curves can be used to illustrate the distribution of the lighting. It will be noted that the beam is located below the horizontal, and that it has an oblique cut-off toward the right at an angle $\alpha$ of 15° to the horizontal.

In a particular example, the lighting device with four modules 11, 12, 13, 14 may have the following dimensions:

dimension b' in the direction X: 80 mm;

dimension c' in the direction Y: 160 mm; and dimension a' in the direction Z: 31 mm.

The dimension e' of the common output surface 3 in the direction Z is about 20 mm.

The vertical parallel lateral faces 4 of the modules 11, 12, 13, 14 form intermediate walls between the modules 11, 12, 13, 14. Two adjacent modules may have, at their common surface, either two adjacent lateral walls 4, each corresponding to one module, or a single lateral wall 4 common to both modules. These lateral walls 4 may be aluminum-coated, since they are intended to prevent the beams produced by a light source 8 placed next to a light orientation guide of one module from passing through the light orientation guide of the adjacent module.

Figure 10:
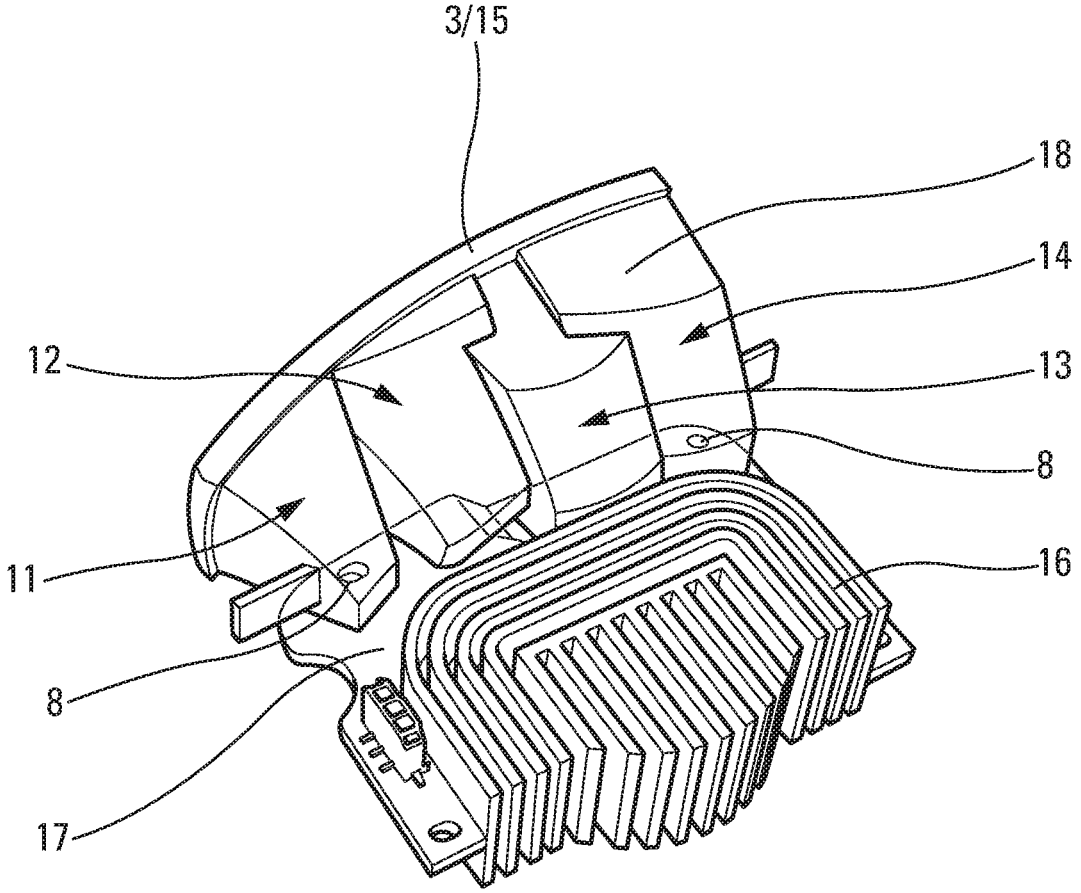
FIG. 10 shows an example of the integration of the lighting device according to FIGS. 7 and 8 into a headlight.

Another example of the nesting of four modules 11, 12, 13, 14 forming a lighting device is shown in FIG. 10, which represents, notably, the lateral walls 4. The lateral walls 4 have shapes which in some cases are complex, with stepped parts, so that they can be fitted into each other.

This lighting device is integrated into a headlight comprising:

a housing 18 to be fixed on a vehicle, an outer lens 15 for sealing the housing, positioned in front of the common output surface 3 of the lighting device.

The lighting device being housed inside the space delimited by the housing 18 and the sealing outer lens 15, the lighting device being arranged so that the rays emerging from the common output surface 3 reach the sealing outer lens 15.

The LEDs 8 of the lighting device are positioned on a substrate 17 which comprises precise locations for this purpose. A heat sink 16 is conventionally connected to this substrate 17.

Although the lighting device according to the invention has been described in the context of a beam with an oblique cut-off, this device may also be adapted to other types of beams with cut-offs, requiring the same optical apparatus and different positions of the light sources 8 for generating respective light beams compatible with different types of regulations. On the other hand, the lighting device according to the invention may be a lighting and/or signaling device.

The configurations shown in the cited figures are only possible examples without any limiting effect on the invention, which incorporates all variant forms and designs that can be produced by persons skilled in the art.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A lighting device for a motor vehicle, comprising:

a plurality of modules having an optical axis O, each of the plurality of modules including, a light source configured to emit a light beam in an overall direction substantially forming a secant to said optical axis O, and a light orientation guide configured to direct said light beam emitted by said light source in a manner substantially parallel to said optical axis O at an output of same light orientation guide and to form a cut-off in said light beam, the light orientation guide including at least one lateral wall configured to prevent the light beam from passing into an adjacent light orientation guide based on a total internal reflection; and a single continuous output surface of the plurality of modules for the output of said light beam, the single continuous output surface being continuously curved, common to each of the plurality of modules, and seamlessly connected to the light orientation guide of each module of the plurality of modules, wherein at least two of the modules are adjacent one another and have mutually different lengths in a direction parallel to said optical axis O, and wherein at least two of the modules are adjacent one another and have the same length in the direction parallel to said optical axis O.

2. The lighting device according to claim 1, wherein said light orientation guide includes three optical surfaces, said optical surfaces including, an input face associated with said light source, an output face coinciding with said common output surface of said lighting device, and a reflecting face for reflecting the light beam emitted from the light source toward the output face, wherein the common output surface is configured to collimate light reflected from the reflecting face of each light orientation guide.

3. The lighting device according to claim 2, wherein said input face of said light orientation guide is configured to refract said light beam received from said light source toward said reflecting face.

4. The lighting device according to claim 3, wherein said reflecting face of said light orientation guide is configured to collect said refracted light beam received from said input face and to reflect said light beam toward said output face of said light orientation guide.

5. The lighting device according to claim 4, wherein said reflecting face has a focus F and said light source is positioned in the vicinity of said focus F so that said light beam reflected by said reflecting face toward said output face has a cut-off.

6. The lighting device according to claim 2, wherein said reflecting face has a generally parabolic profile, a focus F being located near said light source.

7. The lighting device according to claim 5, wherein said light source has a center of symmetry off-center relative to said focus F of said reflecting face with an offset din a direction of said optical axis O.

8. The lighting device according to claim 5, wherein said light source includes a surface for the emission of said light beam including a lateral edge, said light source being located in the surface, and said focus F of said reflecting face being located on said lateral edge.

9. The lighting device according to claim 8, wherein said lateral edge is substantially perpendicular to said optical axis O.

10. The lighting device according to claim 8, wherein said lateral edge is at an angle substantially equal to 15° to said optical axis O.

11. The lighting device according to claim 2, wherein said output face of said light orientation guide is configured to project said light beam reflected by said reflecting face to infinity.

12. The lighting device according to claim 2, wherein the light orientation guide includes two lateral walls, each of the two parallel lateral walls being aluminum-coated.

13. The lighting device according to claim 12, wherein said lighting device comprises at least one module wherein said light source is positioned so that a lateral edge is substantially perpendicular to said optical axis O and at least one module wherein said light source is positioned so that said lateral edge is at an angle substantially equal to 15° to said optical axis O.

14. The lighting device according to claim 1, comprising four of said modules aligned in a direction transverse to said direction parallel to said optical axis O, wherein two adjacent ones of said four modules located closer to a center of the lighting device in said direction transverse to said direction parallel to said optical axis O have a first length in the direction parallel to said optical axis O, and two of said four modules located farther from a center of the lighting device in said direction transverse to said direction parallel to said optical axis O have a second length in the direction parallel to said optical axis O, wherein said second length is greater than said first length.

15. A headlight for a motor vehicle, comprising:

at least one lighting device including, a plurality of modules having an optical axis O, each of the plurality of modules including, a light source configured to emit a light beam in an overall direction substantially forming a secant to said optical axis O, and a light orientation guide configured to direct said light beam emitted by said light source in a manner substantially parallel to said optical axis O at an output of same light orientation guide and configured to form a cut-off in said light beam, the light orientation guide including at least one lateral wall configured to prevent the light beam from passing into an adjacent light orientation guide based on a total internal reflection, and a single continuous output surface of said plurality of modules for the output of said light beam, the single continuous output surface being continuously curved, common to each of the plurality of modules and seamlessly connected to the light orientation guide of each module of the plurality of modules, wherein at least two of the modules are adjacent one another and have mutually different lengths in a direction parallel to said optical axis O, and wherein at least two of the modules are adjacent one another and have the same length in the direction parallel to said optical axis O.

16. The headlight according to claim 15, wherein the light beam emitted from said output of said lighting device form a part or a whole of a regulation beam of a high or low beam type.

17. The lighting device according to claim 3, wherein said reflecting face has a generally parabolic profile, a focus F being located near said light source.

18. The lighting device according to claim 6, wherein said light source has a center of symmetry off-center relative to said focus F of said reflecting face, with an offset d in a direction of said optical axis O.

19. The lighting device according to claim 6, wherein said light source includes a surface for the emission of said light beam including a lateral edge, said light source being located in the surface, and said focus F of said reflecting face being located on said lateral edge.

20. The headlight for a motor vehicle according to claim 15, the light orientation guide includes three optical surfaces, the optical surfaces including, an input face associated with said light source, an output face coinciding with said common output surface of said lighting device, and a reflecting face for reflecting the light beam emitted from the light source toward the output face, wherein the common output surface is configured to collimate light reflected from the reflecting face of each light orientation guide.

21. The lighting device according to claim 15, comprising four of said modules aligned in a direction transverse to said direction parallel to said optical axis O, wherein two adjacent ones of said four modules located closer to a center of the lighting device in said direction transverse to said direction parallel to said optical axis O have a first length in the direction parallel to said optical axis O, and two of said four modules located farther from a center of the lighting device in said direction transverse to said direction parallel to said optical axis O have a second length in the direction parallel to said optical axis O, wherein said second length is greater than said first length.

22. A lighting device for a motor vehicle, comprising:

a plurality of modules, each of said plurality of modules having an optical axis O includes, a light source configured to emit a light beam in an overall direction substantially forming a secant to said optical axis O, and a light orientation guide configured to direct said light beam substantially parallel to said optical axis O at an output of the light orientation guide and to form a cut-off in said light beam, the light orientation guide including three optical surfaces and two parallel lateral walls, the three optical surfaces including an input face associated with the light source, an output face including a common output surface of the lighting device, and a reflecting face for reflecting light rays sent from the input face toward the output face, and the two parallel lateral walls being configured to prevent the light beam from passing into an adjacent light orientation guide based on a total internal reflection; and a single continuous output surface of said plurality of modules for the output of said light beam, the single continuous output surface being continuously curved, common to each of said plurality of modules, and seamlessly connected to the light orientation guide of each module of the plurality of modules, wherein at least two of the modules are adjacent one another and have mutually different lengths in a direction parallel to said optical axis O, and wherein at least two of the modules are adjacent one another and have the same length in the direction parallel to said optical axis O.

23. The lighting device according to claim 22, comprising four of said modules aligned in a direction transverse to said direction parallel to said optical axis O, wherein two adjacent ones of said four modules located closer to a center of the lighting device in said direction transverse to said direction parallel to said optical axis O have a first length in the direction parallel to said optical axis O, and two of said four modules located farther from a center of the lighting device in said direction transverse to said direction parallel to said optical axis O have a second length in the direction parallel to said optical axis O, wherein said second length is greater than said first length.

* * * * *